US005275083A

United States Patent [19]

Hawke et al.

[11] Patent Number: 5,275,083

[45] Date of Patent: Jan. 4, 1994

[54] SKIRTED PROJECTILES FOR RAILGUNS

[75] Inventors: Ronald S. Hawke, Livermore; Allan R. Susoeff, Pleasanton, both of Calif.

[73] Assignee: The United States of America as represented by the United States Department of Energy, Washington, D.C.

[21] Appl. No.: 964,473

[22] Filed: Oct. 21, 1992

Related U.S. Application Data

[63] Continuation of Ser. No. 842,761, Feb. 28, 1992, abandoned, which is a continuation of Ser. No. 523,494, May 14, 1990, abandoned.

[51] Int. Cl.[5] ..... F41B 6/00

[52] U.S. Cl. ..... 89/8; 102/501; 124/3

[58] Field of Search ..... 89/1.816, 8; 102/501; 124/3

[56] References Cited

U.S. PATENT DOCUMENTS

| | | | |
|---|---|---|---|
| 1,450,558 | 4/1923 | Maze | 102/501 |
| 2,802,399 | 8/1957 | Little | 89/1.816 |
| 4,343,223 | 8/1982 | Hawke et al. | 89/8 |
| 4,423,662 | 1/1984 | McAllister | 89/8 |
| 4,437,383 | 3/1984 | Deis et al. | 89/8 |
| 4,467,696 | 8/1984 | McNab et al. | 89/8 |
| 4,471,699 | 9/1984 | Turco et al. | 102/501 |
| 4,485,720 | 12/1984 | Kemeny | 89/8 |
| 4,625,618 | 12/1986 | Howanick | 89/8 |

OTHER PUBLICATIONS

Usuba et al, "Development of Railgun Accelerator Combined With Two-Stage Light Gas Gun," IEEE Transactions on Magnetics, vol. MAG-20, No. 2, Mar. 1984, pp. 260-263.

Hawke et al, "Plasma Armature Formation In High--Pressure, High-Velocity Hydrogen," IEEE Transactions on Magnetics, vol. 25, No. 1, Jan. 1989, pp. 219-222.

Webster's New World Dictionary, 1957, "parallel" pp. 1060-1061, "surface" p. 1467.

Thio, Y. C., "Feasibility Study of a Railgun as a Driver for Impact Fusion", DOE/ER/13048-3, Jun. 1986, pp. 6-1-6-33.

Usuba et al, "Development of Railgun Accelerator at NCLI," IEEE Transactions on Magnetics, vol. MA-G-22, No. 6, Nov. 1986, pp. 1785-1789.

G. A. Clark, Department of Defence, Melbourne, Australia, Report MRL-R-1018 "Evaluation of Capel, A Novel Railgun Concept".

*Primary Examiner*—Stephen C. Bentley

*Attorney, Agent, or Firm*—Henry P. Sartorio; Roger S. Gaither; William R. Moser

[57] ABSTRACT

A single skirt projectile (20) having an insulating skirt (22) at its rear, or a dual trailing skirt projectile (30, 40, 50, 60) having an insulating skirt (32, 42, 52, 62) succeeded by an arc extinguishing skirt (34, 44, 54, 64), is accelerated by a railgun accelerator 10 having a pair of parallel conducting rails (1*a*, 1*b*) which are separated by insulating wall spacers (11). The insulating skirt (22, 32, 42, 52, 62) includes a plasma channel (38). The arc extinguishing skirt (34, 44, 54, 64) interrupts the conduction that occurs in the insulating skirt channel (38) by blocking the plasma arc (3) from conducting current from rail to rail (1*a*, 1*b*) at the rear of the projectile (30, 40, 50, 60). The arc extinguishing skirt may be comprised of two plates (36*a*, 36*b*) which form a horseshoe wherein the plates are parallel to the rails (1*a*, *b*); a chisel-shape design; cross-shaped, or it may be a cylindrical (64). The length of the insulating skirt channel is selected such that there is sufficient plasma in the channel to enable adequate current conduction between the rails (1*a*, 1*b*).

34 Claims, 3 Drawing Sheets

SKIRTED PROJECTILES FOR RAILGUNS

The Government has rights to this invention pursuant to Contract No. W-7405-ENG-48 awarded by the U.S. Department of Energy.

This is a continuation of application Ser. No. 07/842,761 filed Feb. 28, 1992, now abandoned which is a continuation of application Ser. No. 07/523,494 filed May 4, 1990, now abandoned.

TECHNICAL FIELD

The present invention broadly relates to projectiles and more particularly to a projectile having a protective trailing skirt for acceleration by a plasma arc in a railgun.

BACKGROUND OF THE INVENTION

Railgun accelerators have met with limited success in accelerating projectiles from 1 gram to about 1 kilogram to velocities of about 7 km/s. Referring to FIGS. 1*a* and 1*d*, a railgun accelerator 10 having a pair of parallel spaced apart conducting rails 1*a*, 1*b* accelerates a projectile 2 along the rails 1 by establishing a high current plasma arc or armature 3 between the rails 1*a*, 1*b* and behind the projectile 2. The rails 1*a*, 1*b* are spaced apart by insulating wall spacers (or insulators) 11 which, together with rails 1*a*, 1*b* define the railgun barrel.

Under ideal conditions, there is only one current conduction path from rail 1*a* to rail 1*b* and it is located immediately behind the projectile 2. The magnetic fields from the currents in the rails 1*a*, 1*b* couple with the current in the armature to cause a Lorentz force on the plasma arc 3, which then results in a hydrodynamic acceleration pressure on the projectile 2.

In reality, arc growth and separation are aggravated by barrel-wall (or rail) ablation 4 as illustrated in FIG. 1*b*. Referring also to FIG. 1*c*, while the projectile 2 and the plasma arc 3 are being accelerated down the rails 1*a*, 1*b* gradual erosion of the railgun rails 1*a*, 1*b* and insulating wall spacers 11 causes a secondary arc, or restrike 5, to form in the debris left behind by the first armature 3.

In addition to causing the rail ablation 4, the high current plasma arc 3 causes ablation of the insulators 11. In particular, ablation of the insulating wall spacers 11 is much greater than the rail ablation and it introduces undesirable debris into the plasma arc 3 which increases the arc drag force. Hence, a large fraction of the driving force is required to move the arc 3, thus reducing the propulsive force that is available to move the projectile 2. In addition, since the rails 1*a*, 1*b* and the insulating wall spacers 11 are subject to erosion, they have to be replaced frequently.

The secondary arc 5 may form behind the neutral ablation products 4 of the first armature 3 or it may form further towards the breech of the railgun where the rail-to-rail voltage is higher and the gas pressure is lower. In either situation, the secondary arc 5 is undesirable because it reduces the propulsive capability of the railgun, thereby limiting the railgun operating velocity.

Specifically, the secondary arc 5 shunts current away from the primary, propulsive, plasma arc 3 employed to propel the projectile 2. The projectile acceleration force, F, diminishes with the primary current flowing in the propulsive plasma 3, I: where $F=L'I^2/2$ and $L'$ is the inductance gradient of the rail pair. Hence, the propulsive force rapidly decreases as the shunt current grows.

Efforts have been made to accelerate projectiles at velocities greater than 8 to 9 km/s. However, as the velocities increase, the problem of restrike becomes more prevalent and high velocities are difficult to obtain.

A railgun projectile, used in conjunction with a railgun barrel having no insulating wall spacers is discussed in *Evaluation of CAPEL, A Novel Railgun Concept*, Australia Department of Defence, Defence Science and Technology Organization Materials Research Laboratories, Melbournem, Victoria, Report MRL-R-1018, (September, 1986). The railgun projectile has an internal, oval shaped cavity which completely confines a plasma armature within the projectile as the projectile is accelerated along the rails. In this case, the railgun barrel that is used in conjunction with the confined armature projectile design does not have insulating wall spacers. Rather, the walls of the projectile itself serve to confine the hot plasma. The disadvantage of this approach is that the plasma pressure tends to destroy the confining projectile as noted in the report. Hence, Applicant's invention uses the barrel to contain the plasma pressure thereby resulting in plasma contact with insulating rail spacers. By the plasma armature making direct contact with the insulating spacers, the plasma arc severely damages the insulating spacers in the region exposed to the plasma.

The Australian reference does not address the problem of railgun rail erosion caused by the plasma armature directly contacting the rails as the projectile is accelerated. In addition, the projectile design does not reduce or eliminate restrike.

U.S. Patent application, No. 07/341,019, filed Aug. 28, 1989, entitled "Prevention of Breakdown/Restrike Behind Railgun Projectiles," now U.S. Pat. No. 5,142,962 issued Sep. 1, 1992 is herein incorporated by reference. The Prevention of Breakdown/Restrike application is directed to a method-apparatus for preventing secondary voltage breakdown behind a railgun projectile while it is being accelerated by a plasma arc prior to launch. The Prevention of Breakdown application provides that restrike can be eliminated or reduced by configuring the projectile to have a cavity or a shielding skirt at its rear end and/or by fabricating the projectile out of a material which releases a breakdown inhibiting gas as the projectile is accelerated. In one embodiment of the invention the projectile is configured with a V-shaped arc extinguishing trailing skirt at the rear of the projectile. The arc extinguishing skirt shields the railgun rails from the plasma arc and interrupts the current flow to reduce ablation of the rails.

SUMMARY OF THE INVENTION

A projectile, for acceleration in a railgun having rails and insulating spacers therebetween, has confining means which confine the plasma arc to the rails and shields the arc from the insulating spacers. The confining means may include an insulator shielding skirt which shields at least a portion of the insulating spacers as the projectile is being accelerated through the railgun but which allows the plasma arc to contact at least a portion of the rails as the projectile is being accelerated.

The projectile may also have a means for inhibiting the plasma arc from contacting the rails, wherein the means for inhibiting the plasma arc is positioned behind the confining means. The inhibiting means includes an arc extinguishing skirt which shields the plasma arc from contacting a portion of the rails at the rear of the projectile while the confining means confines the plasma to the rails yet shield the plasma from the insulating spacers.

The arc extinguishing skirt includes at least one plate parallel to the rails which may be arcuate-shaped, cross-shaped, or a cylinder with a bore therethrough.

A railgun projectile having a trailing skirt improves the performance of a railgun by preventing ablation of the insulator portions of the railgun barrel and by controlling the length of the plasma arc. The railgun projectile's trailing skirt(s) increases in-bore stability of the projectile, although the increased mass and length of the projectiles may reduce acceleration and increase projectile drag respectively.

The projectile may also be coated with material which enhances the conductivity of the plasma arc and minimizes viscous drag coefficient.

These, and further objects and advantages of the present invention will be made clear or will become apparent during the course of the following description of the preferred embodiment of the present invention.

DETAILED DESCRIPTION OF THE PREFERRED EMBODIMENTS

Figure 1A:
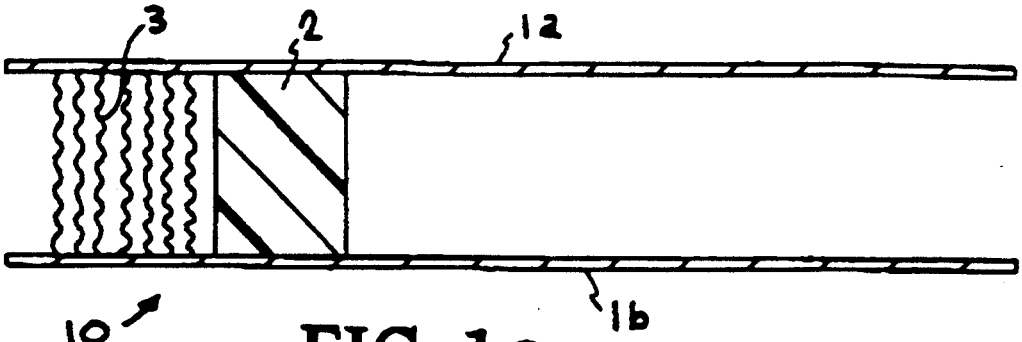
FIG. 1a (PRIOR ART)
FIG. 1*a*, is a side view of a prior art railgun and a railgun projectile accelerated by a plasma arc.
Figure 1B:
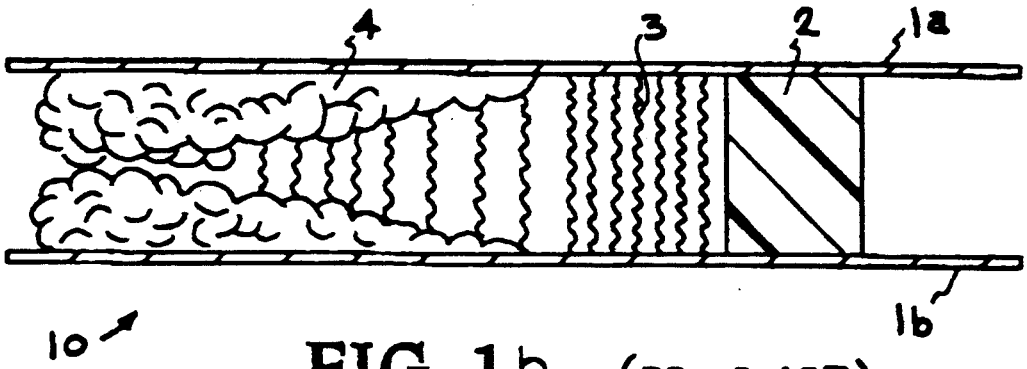
FIG. 1b (PRIOR ART)
FIG. 1*b* is a side view of the prior art railgun and projectile of FIG. 1*a* in the presence of wall ablation.
Figure 1C:
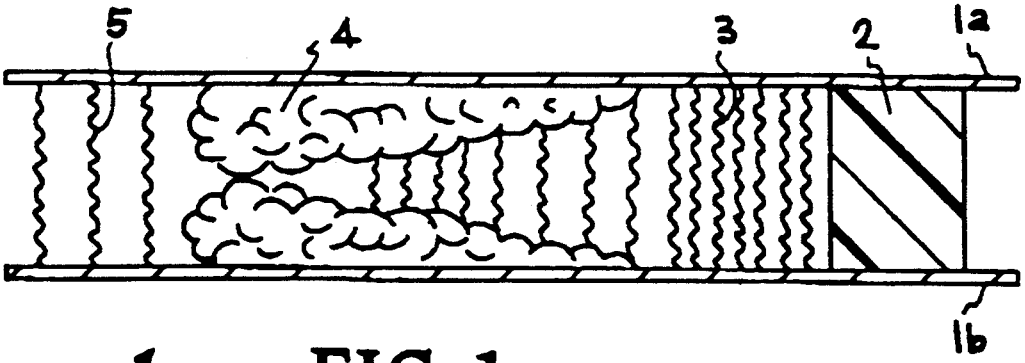
FIG. 1c (PRIOR ART)
FIG. 1*c* is a side view of the prior art railgun and projectile of FIG. 1*a*, in the presence of secondary restrike.
Figure 1D:
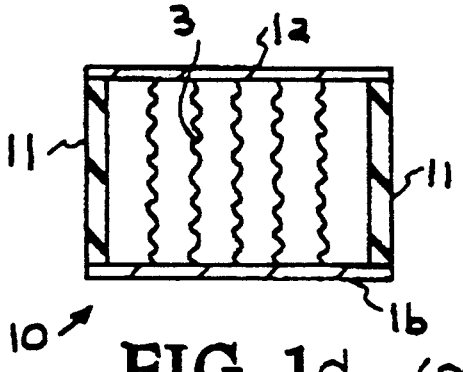
FIG. 1d (PRIOR ART)
FIG. 1*d* is a cross sectional view of the prior art railgun of FIG. 1*a* illustrating the railgun rails separated by insulating wall spacers.
Figure 2:
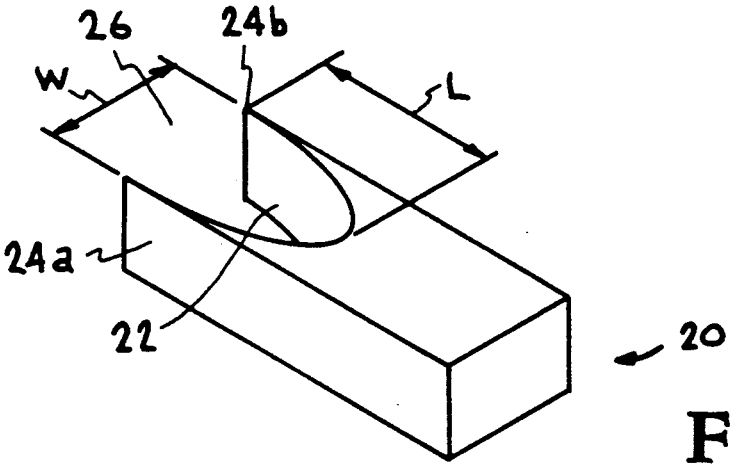
FIG. 2 is a perspective view of a single skirt railgun projectile of the present invention.

Referring to FIG. 2, a single skirt railgun projectile 20 having an insulating skirt 22 at its rear is illustrated. The single insulating skirt 22 confines a plasma arc 3 to the railgun rails 1*a*, 1*b*, as shown in FIG. 1*d* and inhibits it from contacting the railgun insulating wall spacers 11. Thus, the insulating skirt 22 protects the insulating wall spacers 11 from radiation.

Insulating wall spacers 11 are used to control the direction of the plasma in the railgun barrel. The insulating walls assist in confining the plasma from escaping outward and/or around the projectile. In addition, the insulating walls provide confinement support which helps prevent the projectile from breaking.

The insulating skirt 22 has two spaced apart skirt walls 24*a*, 24*b* which are parallel to the insulators 11. The skirt walls 24*a*, 24*b* form a channel 26 having a length L associated therewith wherein at least one end of the channel 26 is closed. The insulating skirt 22 shields the insulating wall spacer 11 from the arc 3 as the arc propagates in the channel 26 from rail 1*a* to rail 1*b* of FIG. 1*d*. Hence, insulating skirt 22 permits the current to flow in the channel 26 from the top rail 1*a* to the bottom rail 1*b*.

The insulating skirt 22 shields the insulating wall spacers 11 from radiating heat, which, in turn, reduces the amount that the barrel insulating walls 11 will be ablated. Since there is less ablated insulating material and the ablated material is isolated from the chamber by the skirts 22, the arc 3 is contaminated less by the ablated insulating material. Hence, the material used as the barrel insulator walls may be selected without regards to its arc ablation properties and some otherwise unsuitable barrel insulator materials, because radiation causes them to erode or turn into conductors, may be used.

In the preferred embodiment the skirt walls 24*a*, 24*b* form an oval or horseshoe-shaped skirt. The horseshoe-shape is preferred because it makes the projectile 20 more light weight and stronger than a rectangular shape, for example.

Figure 3:
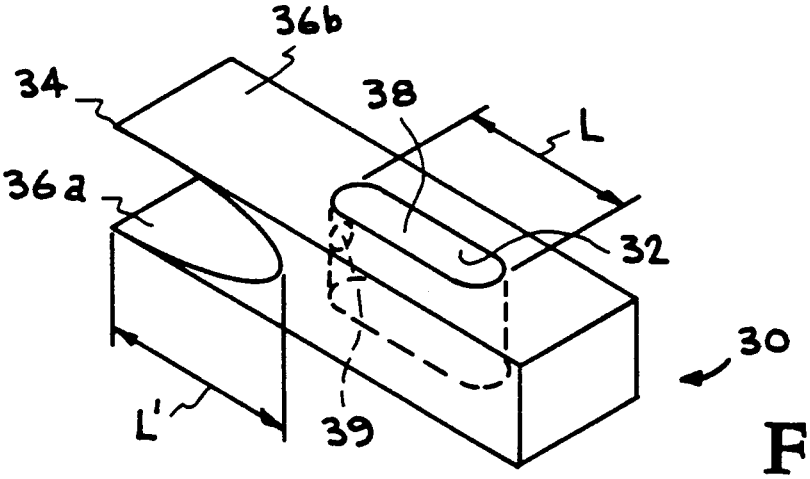
FIG. 3 is a perspective view of a dual trailing skirt railgun projectile of the present invention.

Referring to FIG. 3, a dual trailing skirt railgun projectile 30 is illustrated. In a dual trailing skirt projectile 30, the projectile 30 has two trailing skirts: an insulating skirt 32 and an arc extinguishing skirt 34.

The insulating skirt 32 is similar to, and serves the same function, as the insulating skirt 22 employed in the single trailing skirt projectile 20. (The insulating skirt 32 protects the insulating wall spacers 11 from radiation.) In the dual trailing skirt projectile design 30, a plasma channel 38 is completely enclosed except for on the two surfaces parallel to the rails 1*a*, 1*b* and an exhaust hole 39 from the insulating skirt 32 to the arc extinguishing skirt 36. The enclosed channel 38 has a length L. The cross sectional configuration of the plasma chamber 38 may be any shape: circular, rectangular, square, etc. However, in the preferred embodiment, the cross section is oval shaped. As with the single insulating skirt projectile 20, the plasma arc 3 conducts from rail 1*a* to rail 1*b* in the channel 38.

In the dual trailing skirt railgun configuration 30, the insulating skirt 32 is succeeded by the arc extinguishing skirt 34. The arc extinguishing skirt 34 is a barrier that interrupts the complete rail 1*a* to rail 1*b* conduction that occurs in the insulation skirt channel 38. The arc extinguishing skirt 34 interrupts the conduction by blocking the plasma arc 3 from contacting the rails 1*a*, 1*b* at the rear of the projectile 30.

The arc extinguishing skirt 34 and the insulating skirt 32 intersect such that the exhaust hole 39 between the skirts 32, 34 provides a path where the spent arc constituents can escape. While the arc extinguishing skirt 34 reduces barrel wall ablation, the rails 1*a*, 1*b* are still ablated. The ablated products from the rails and also the inner sides of the skirt 32, accumulate in the insulating skirt channel 38 unless a vent is used to exhaust the ablation products from the plasma chamber 38, and pressure would build inside the chamber.

The arc extinguishing skirt 34 may be any shape so long as it interrupts the rail to rail current path in the channel 38. In the preferred embodiment of FIG. 3, the arc extinguishing skirt 34 is comprised of two spaced apart plates 36*a*, 36*b* which form a horseshoe, similar to the horseshoe shaped insulating skirt 22 in the single skirt projectile 20. In the dual skirt projectile 30 configuration the horseshoe shaped extinguishing skirt 34 is rotated 90°, in relation to the horseshoe shaped insulating skirt 22 in the single skirt projectile 20 design, so that the plates 36*a* and 36*b* are parallel to the railgun rails 1*a*, 1*b*. The plates 36*a* and 36*b* are approximately the same width as the body of projectile 30.

Figure 4:
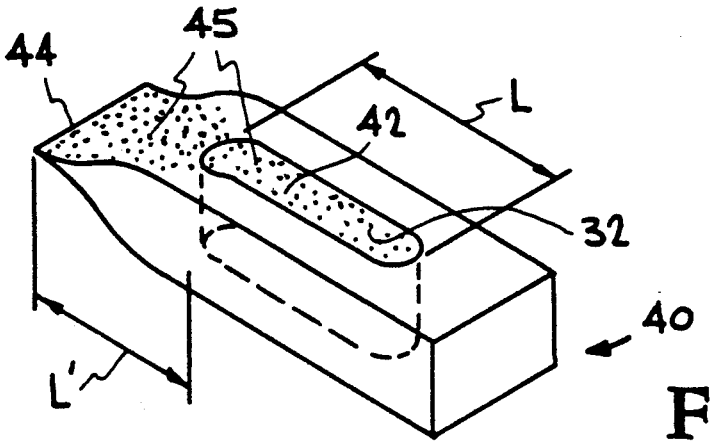
FIG. 4 is a perspective view of an alternate dual trailing skirt railgun projectile of the present invention.

Referring to FIG. 4, a chisel-shaped dual trailing skirt projectile 40, having two trailing skirts 32, 44, is illustrated. Similar elements in the various illustrated embodiments are referred to with the same name/reference numerals. The chisel-shaped projectile 40 is similar to the dual trailing skirt projectile of FIG. 3 except that a chisel-shaped arc extinguishing skirt 44 is presented. The chisel-shaped arc extinguishing skirt 44 is comprised of a single plate which protrudes at the rear of the projectile 40, behind the insulating skirt 32, and is parallel to the rails 1*a*, 1*b*. The width of the chisel-shaped skirt 44 is about equal to the width of the projectile 40 such that the chisel-shaped skirt 44 effectively terminates current from flowing between the rails 1*a*, 1*b*.

Figure 5:
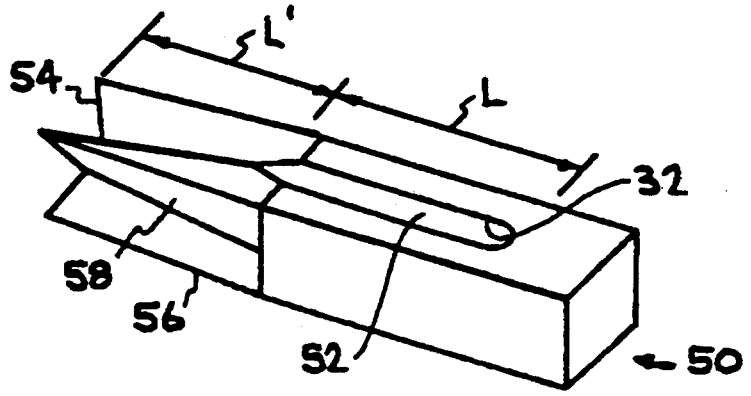
FIG. 5 is a perspective view of another dual trailing skirt railgun projectile of the present invention.

Referring to FIG. 5, a cross-shaped dual trailing skirt projectile 50 is illustrated. The cross shaped dual trailing skirt projectile 50 also has two trailing skirts 32, 54 wherein the cross-shaped arc extinguishing skirt 54 succeeds the insulating trailing skirt 32. The cross-shaped extinguishing skirt 54 protrudes from the main body of the projectile 50 and is comprised of two intersecting plates 56, 58 arranged in the form of an "X".

Figure 6:
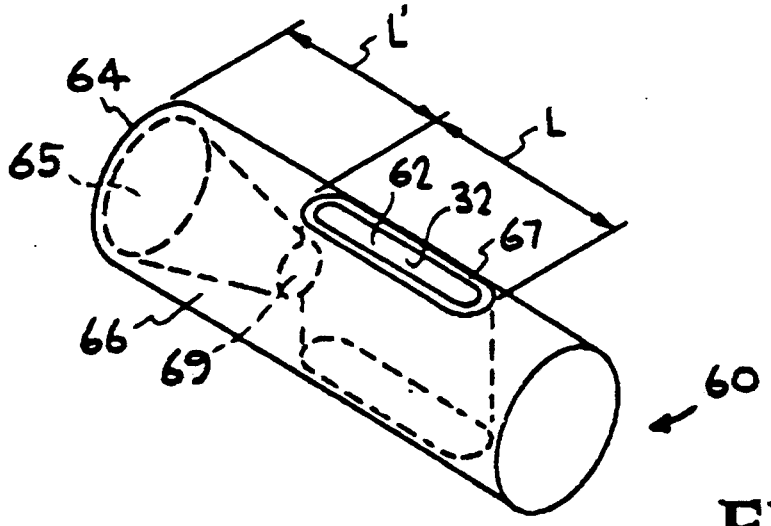
FIG. 6 is a perspective view of yet another dual trailing skirt railgun projectile of the present invention.

Referring to FIG. 6, a cylindrical dual trailing skirt railgun projectile 60, having the insulating skirt 32 and a cylindrical arc extinguishing skirt 64, is illustrated. The arc extinguishing skirt 64 is a hollow cylinder 66 located at the rear of the projectile 60 and coaxial with the projectile. In the preferred embodiment, the cylinder 66 is round, however, it may be any shape so long as the arc extinguishing skirt 64 has a minimum of 2 surfaces which are parallel to the rails 1*a*, 1*b* .The arc extinguishing skirt is hollow in the center 65 and intersects at hole 69 with the insulating skirt 32. Having a hollow center 65 is preferred since it makes the projectile lighter and also provides a means through which the ablated material, which accumulates in the insulating skirt chamber may be vented.

The dual trailing skirt of the projectile 30, 40, 50, 60 configuration controls the length of the plasma arc 3 travelling through the railgun barrel. The length of the plasma arc 3 is dependent upon the length L of the insulating skirt channel 38, 42, 52, 62 and the length L' of the arc extinguishing skirt 34, 44, 54, 64.

The length of the insulating skirt channel 26, 38, 42, 52, 62 is selected such that there is sufficient plasma in the channel to enable adequate current conduction between the rails 1*a*, 1*b* and also so that there is sufficient exposed rail electrode area to permit sufficient electron emission from the cathode rails by thermionic, field effect and/or photo effect to supply the arc current.

The arc extinguishing skirt 34, 44, 54, 64 extinguishes the plasma arc 3 by breaking the arc's conduction of current between the rails 1*a*, 1*b* of FIG. 1*d* which cools the arc 3 thereby extinguishing it. Cooling occurs when electrical current conduction ceases by 1 interrupting the current flowing through the arc by the extinguishing skirt 34, 44, 54, 64; and/or by 2) the arc contacting the projectile or barrel which have been fabricated out of material which transpires such that the plasma arc's byproducts are rendered less conductive when they mix with the transpirational material. The resulting cooler, nonconducting plasma arc is located behind the projectile 30, 40, 50, 60. The cool plasma arc prevents the primary plasma arc 3 from lengthening and reduces the chances of a second restrike plasma arc forming out of the byproducts from the primary arc 3.

The insulating skirts 22 and 32, shown in FIGS. 2 and 3–6 may also be lined or coated with an arc seeding material as indicated at 67 in FIG. 6 to enhance the conductivity of the plasma arc 3 and to minimize the viscous drag coefficient of the plasma arc 3. The general characteristics of a desirable arc seeding material is that it is either a good conductor in the plasma state or that it provides conductive products. Examples of arc inhibiting materials which improve current conduction in the plasma armature and minimize viscous drag, include hydrogen which can be released from hydrogen absorbing materials such as palladium; compounds that contain hydrogen or light metal ions; LiH; Li metal; Al metal; Mg metal; alloys containing Li, B, Al, or Mg; frozen or liquid hydrogen; hydrogen boron compounds; hydrogen boron compounds with high H:B ratios; hydrocarbons with high H:C ratios and hydrogen, helium, or nitrogen mixed with a compound containing at least one halogen atom.

The insulating skirts and/or arc extinguishing skirts 34, 44, 54, 64 may be lined or coated with a material as illustrated at 45 in FIG. 4, for example, which limits arc growth and which provides constituents that increase the breakdown voltage behind the arc extinguishing skirt. Examples of coatings 45 for arc extinction and breakdown inhibition include Freon $SF_6$ (coated, frozen, or contained in wax, grease or other material); silicone oil, grease or wax; fluorine and/or chlorine bearing compounds to enhance free electron capture; and electron "getter" ions (e.g., fluorine, chlorine) implanted in the surface of the projectile and/or barrel wall materials.

The dual trailing skirt projectile provides: (1) a means to limit arc length by using a second trailing skirt to interrupt current flow between the rails; (2) a region long enough to allow the interrupted plasma to electrically recombine and exhaust at the rear of the projectile while in the neutral state which prevents a second arc from forming; (3) a configuration which is suitable for fabrication out of arc inhibiting constituents which increase the breakdown voltage between the rails after the passage of the projectile; and (4) increased effective projectile aspect ratio (length to diameter) resulting in increased in-bore stability without the mass penalty of solid projectiles. The longer aspect ratio reduces the degree to which the projectile can tilt with respect to the barrel thereby reducing the likelihood of projectile balleting and collision with the barrel wall.

Having thus described the invention, it is recognized that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalents thereof within the scope of the invention.

What is claimed is:

1. A projectile for acceleration in a railgun by a plasma arc, wherein the railgun has substantially parallel rails and insulating spacers therebetween to define a barrel bore, and wherein the projectile, having a length associated therewith and a longitudinal axis extending substantially parallel to the rails, is accelerated between the rails, wherein the projectile comprises:

a projectile body having a longitudinally extending axis aligned with the axis of the projectile, an insulator shielding section and an arc extinguishing section, said body additionally having a longitudinally extending aperture located in said insulator shielding section and having a substantially constant cross-section extending through said body transverse to said axis of said body and terminating at opposite sides of said body, said longitudinally extending aperture having a length substantially greater than the width thereof, said aperture being configured to define a means for confining the plasma arc to the rails and for shielding the plasma arc from the insulating spacers;

said body additionally defining an exhaust means having a diverging configuration, and having a smaller end thereof intersecting a central section of said longitudinally extending aperture.

2. The projectile of claim 1, wherein the means for confining and shielding the plasma arc located in said insulator shielding section of said body defines an insulator shielding skirt formed by surfaces of said longitudinally extending aperture in said body which shields at least a portion of the insulating spacers as the projectile is being accelerated and which allows the plasma arc to contact at least a portion of the rails as the projectile is being accelerated.

3. The projectile of claim 2, wherein the projectile has a first pair of sides parallel to the insulating spacers and a second pair of sides parallel to the rails, a front end and a rear end wherein the insulator shielding skirt is parallel to the insulating spacers.

4. The projectile of claim 2, wherein the insulation shielding skirt is coated with an arc inhibiting material.

5. The projectile of claim 1, wherein said arc extinguishing section of said body includes:

means for limiting the length of the plasma arc, wherein the means for limiting the plasma arc is positioned behind the means for confining the plasma arc and interrupts the plasma arc contact with a portion of the rails at the rear of the projectile.

6. The projectile of claim 5, wherein the means for limiting the length of the plasma arc includes an arc extinguishing skirt which shields the plasma arc from contacting the portion of the rails at the rear of the projectile.

7. The projectile of claim 6, wherein the arc extinguishing skirt includes at least one longitudinally extending surface portion parallel to the rails.

8. The projectile of claim 7, wherein the arc extinguishing skirt includes an arcuate-shaped portion.

9. The projectile of claim 7, wherein the arc extinguishing skirt is cross-shaped.

10. The projectile of claim 7, wherein the arc extinguishing skirt is chisel-shaped.

11. The projectile of claim 6, wherein the arc extinguishing skirt is of a cylindrical configuration formed coaxial with the projectile and has a substantially constant outwardly tapering bore therein coaxial with the projectile and defining said exhaust means which intersects said central section of said longitudinally extending aperture in said body.

12. The projectile of claim 6, wherein at least a portion of the arc extinguishing skirt is coated with an arc inhibiting material.

13. The projectile of claim 5, further including means for introducing behind the accelerating projectile an arc inhibiting material which limits the length of the plasma arc.

14. The projectile of claim 13, wherein the railgun has a breakdown voltage associated therewith and wherein:

the arc inhibiting material limits the plasma arc length and introduces constituents into the barrel, behind the means for confining, which increase the breakdown voltage.

15. The projectile of claim 13, wherein the arc inhibiting material is selected from the group consisting of $SF_6$, FREON, fluorine, hydrogen mixed with a compound containing at least one halogen atom, helium mixed with a compound containing at least one halogen atom, and nitrogen mixed with a compound containing at least one halogen atom.

16. The projectile of claim 15, wherein the arc inhibiting material is a gas is selected from the group consisting of $SF_6$, FREON, fluorine, hydrogen mixed with a compound containing at lest one halogen atom, helium mixed with a compound containing at least one halogen atom, and nitrogen mixed with a compound containing at least one halogen atom.

17. The projectile of claim 13, wherein the arc inhibiting material is an electron gathering gas.

18. The projectile of claim 17, wherein the arc seeding material is a conductor in a plasma state thereby improving conduction through the plasma arc.

19. The projectile of claim 17, wherein the arc seeding material provides conductive products.

20. The projectile of claim 17, wherein the arc seeding material is selected from the group consisting of a hydrogen absorbing material which contains hydrogen and which releases hydrogen, a compound which contains light metal ions, hydrocarbons with a high hydrogen to carbon ratio, hydrogen boron compounds with a high hydrogen to boron ratio, an alloy containing lithium, and an alloy containing aluminum, an alloy containing magnesium.

21. The projectile of claim 5, wherein the means for confining includes means for introducing an arc seeding material behind the accelerating projectile.

22. The projectile of claim 1, wherein the aperture has an oval-shaped cross section.

23. The projectile of claim 1, further including means for introducing behind the accelerating projectile an arc inhibiting material which limits the length of the plasma arc.

24. The projectile of claim 23, wherein the railgun has a breakdown voltage associated therewith and wherein:

the arc inhibiting material limits the plasma arc length and introduces constituents into the barrel, behind the means for confining, which increase the breakdown voltage.

25. The projectile of claim 23, wherein the arc inhibiting material is selected from the group consisting of $SF_6$, FREON, fluorine, hydrogen mixed with a compound containing at least one halogen atom, helium mixed with a compound containing at least one halogen atom, and nitrogen mixed with a compound containing at least one halogen atom.

26. The projectile of claim 25, wherein the arc inhibiting material is a gas is selected from the group consisting of $SF_6$, FREON, fluorine, hydrogen mixed with a compound containing at least one halogen atom, helium mixed with a compound containing at least one halogen atom, and nitrogen mixed with a compound containing at least one halogen atom.

27. The projectile of claim 23, wherein the arc inhibiting material is an electron gathering gas.

28. The projectile of claim 1, wherein the means for confining includes means for introducing an arc seeding material behind the accelerating projectile.

29. The projectile of claim 28, wherein the arc seeding material is a conductor in a plasma state thereby improving conduction through the plasma arc.

30. The projectile of claim 28, wherein the arc seeding material provides conductive products.

31. The projectile of claim 28, wherein the arc seeding material is selected from the group consisting of a hydrogen absorbing material which contains hydrogen and which releases hydrogen, a compound which contains light metal ions, hydrocarbons with a high hydrogen to carbon ratio, hydrogen boron compounds with a high hydrogen to boron ratio, an alloy containing lithium, and an alloy containing aluminum, an alloy containing magnesium.

32. A method for fabricating a projectile for acceleration in a railgun by a plasma arc, comprising the steps of:

forming a longitudinally extending projectile body, having an axis;

providing the projectile body with means for configuring the plasma arc by forming an aperture extending through the body from one side to the opposite side;

forming the aperture so as to have a substantially constant cross-section, which extends transversely to the axis of the body;

forming the aperture so as to define a longitudinally extending length which is substantially greater than the height of the aperture;

providing the projectile body with means for limiting the length of the plasma arc located behind the means for confining the plasma arc; and providing the projectile body with tapering exhaust means and such that a smaller end of the tapering exhaust means intersects the longitudinally extending aperture.

33. The method of claim 32, including the step of forming the means for limiting the length of the plasma arc by providing the body with an arc extinguishing skirt having a configuration selected from the group of arcuate-shaped, chisel-shaped, cross-shaped, and cylindrically-shaped.

34. The method of claim 32, additionally including the step of providing means for introducing behind the projectile body an arc inhibiting material.

* * * * *